US011525167B2

(12) United States Patent
Geeroms et al.

(10) Patent No.: US 11,525,167 B2
(45) Date of Patent: Dec. 13, 2022

(54) OPERATING METHOD OF AN IRON MAKING INSTALLATION AND ASSOCIATED OPERATING INSTALLATION

(71) Applicant: ArcelorMittal, Luxembourg (LU)

(72) Inventors: Joris Geeroms, Ghent (BE); Kurt Spelier, Ghent (BE); Stefaan Van De Casteele, Ghent (BE)

(73) Assignee: ArcelorMittal, Luxembourg (LU)

( * ) Notice: Subject to any disclaimer, the term of this patent is extended or adjusted under 35 U.S.C. 154(b) by 138 days.

(21) Appl. No.: 16/619,044

(22) PCT Filed: Jun. 15, 2018

(86) PCT No.: PCT/IB2018/054413
§ 371 (c)(1),
(2) Date: Dec. 3, 2019

(87) PCT Pub. No.: WO2018/229720
PCT Pub. Date: Dec. 20, 2018

(65) Prior Publication Data

US 2020/0087742 A1 Mar. 19, 2020

(30) Foreign Application Priority Data

Jun. 16, 2017 (WO) ..... PCT/IB2017/000739

(51) Int. Cl.
*C21B 5/00* (2006.01)
*C10B 57/10* (2006.01)
(Continued)

(52) U.S. Cl.
CPC ..... *C21B 5/003* (2013.01); *C10B 57/10* (2013.01); *C10L 5/04* (2013.01); *C10L 9/08* (2013.01);
(Continued)

(58) Field of Classification Search
CPC . C10B 57/10; C21B 2100/62; C21B 2100/64; C21B 2200/00; C21B 5/003;
(Continued)

(56) References Cited

U.S. PATENT DOCUMENTS

| | | | |
|---|---|---|---|
| 6,797,034 | B2 | 9/2004 | Sugitatsu et al. |
| 2003/0027088 | A1 | 2/2003 | Ueno et al. |
| 2014/0306386 | A1 | 10/2014 | Bartol |

FOREIGN PATENT DOCUMENTS

| | | | |
|---|---|---|---|
| CN | 1201022 | C | 5/2005 |
| DE | 19606575 | A1 | 8/1997 |

(Continued)

OTHER PUBLICATIONS

See International Search Report of PCT/IB2018/054413, dated Oct. 10, 2018.

*Primary Examiner* — Latosha Hines
(74) *Attorney, Agent, or Firm* — Davidson, Davidson & Kappel, LLC

(57) ABSTRACT

A method of operating an iron making installation is provided, in which waste material is dried using a drying gas, the drying gas including an exhaust gas from a sinter plant, and the dried material is roasted a roasting gas, so as to produce coal and a roasting exhaust gas. An associated installation is also provided.

32 Claims, 1 Drawing Sheet

(51) Int. Cl.
*C10L 5/04* (2006.01)
*C10L 9/08* (2006.01)
*C21B 5/02* (2006.01)

(52) U.S. Cl.
CPC ..... *C21B 5/023* (2013.01); *C10L 2290/08* (2013.01); *C21B 2100/62* (2017.05); *C21B 2100/64* (2017.05); *C21B 2200/00* (2013.01)

(58) Field of Classification Search
CPC ..... C21B 5/023; C10L 2290/08; C10L 5/04; C10L 9/08; Y02E 50/10; Y02P 10/20
See application file for complete search history.

(56) References Cited

FOREIGN PATENT DOCUMENTS

| | | | | |
|---|---|---|---|---|
| EP | 1264901 | B1 | | 7/2009 |
| JP | S58199827 | A | | 11/1983 |
| JP | H0331432 | A | | 2/1991 |
| JP | 3027191 | U | | 7/1996 |
| JP | H09235559 | A | | 9/1997 |
| JP | 2007169780 | A | | 7/2007 |
| JP | 2009057438 | A | | 3/2009 |
| JP | 2009057438 | A | * | 3/2009 |
| JP | 2010078202 | A | | 4/2010 |
| JP | 2010078202 | A | * | 4/2010 |
| JP | 2012017528 | A | | 1/2012 |
| KR | 20020052147 | A | | 7/2002 |
| RU | 2244016 | C2 | | 1/2005 |
| WO | WO2007061126 | A1 | | 5/2007 |
| WO | 2011052796 | A1 | | 5/2011 |
| WO | 2016043651 | A1 | | 3/2016 |

* cited by examiner

OPERATING METHOD OF AN IRON MAKING INSTALLATION AND ASSOCIATED OPERATING INSTALLATION

The invention is related to an operating method of an iron making installation and to the associated installation.

BACKGROUND

The iron making process, which can be either performed in a blast furnace or a DRI furnace such as MIDREX® or COREX® always require the use of a carbon containing material as raw material. This carbon containing material can either be brought as pulverized coal, charcoal, coke or other forms.

In recent years, in the course of $CO_2$ reduction there has been a lot of development aiming at recycling carbon-containing waste materials as substitute to these carbon containing materials. Those carbon-containing waste materials maybe for example wood from construction area, agricultural or food residues, home trash or industrial wastes. In the rest of the text, term waste material will be used and has to be understood as carbon-containing waste material.

For example, patent publication WO 2011/052796 describes a method of using biomass, such as wood waste from construction or agricultural waste as a substitute for pulverized coal in a blast furnace. In this method the biomass is dried in a rotary kiln to manufacture biomass coal, the biomass is then pulverized together with coal and blown through a tuyere into the blast furnace. The exhausts gas of the rotary kiln are collected and sent to a gas heater which further re-injects them into the rotary kiln as a heating source of the outer row.

Patent EP 1 264 901 B1 from Kobe Steel describes a method for producing reduced iron in which organic matter-containing components such as wood, resin, trash or industrial waste are loaded into a carbonization furnace together with iron oxide which is used at heat medium. The product of this carbonization is then agglomerated and used as reducing agent into a reduction furnace. In the described method, the exhausts gas from the reduction furnace are used as combustion gas into the carbonization furnace, while the distilled gas resulting from the carbonization are used as fuel for the reduction furnace.

Patent Publication US 2014/0306386 describes a method of using wood as fuel into a blast furnace. In this method wood is sized and dried, coarse particles are then loaded into the throat of the blast furnace while finer particles are sent to a combustion chamber. Hot gas exhausted from the combustion chamber are either sent to a power plant or used at heat source to preheat the hot blast further injected into the blast furnace. Top gas exhausted from the blast furnace is used as gas source for the combustion.

Patent Publication JP 2009-057438 describes aims to provide a manufacturing method of pulverized carbon material resulting from biomass carbonization whose resulting product may be easily turned into a fine powder suitable for blowing into the blast furnace while achieving high efficient recovery of energy in the biomass.

In none of these patent documents is taken into account the variability of the waste materials. Indeed the characteristics of those materials may vary in terms of humidity and calorific power from one batch to another. Consequently the calorific power of the carbonization exhaust gas will also vary depending on the waste material which is roasted and in some cases the resulting exhausts gas will not release enough energy to roast the following batch of waste material. External energy supply may then be needed.

Patent application DE 196 06 575 A1 discloses a method for managing residual and waste material of any kind. In this document, waste materials are pre-treated in a pyrolysis reactor which can be heated thanks to blast furnace top gas. Roasted material is then separated between ferrous and non-ferrous materials. Ferrous materials are then sent to a mill and injected in the blast furnace through the tuyere.

BACKGROUND

Moreover those waste materials may comprise a lot of volatile compounds which are detrimental to the environment. It is so necessary to have a specific treatment step of the exhausts gas so as to remove these components and avoid them to be released into the atmosphere.

It is an object of the present invention to provide an operating method of an iron making installation which is independent of the characteristics of the waste materials used in the iron making process and which prevents pollutants from being released into the atmosphere without necessity of dedicated equipment.

An additional aim of the invention is to improve overall carbon balance by substituting fossil carbon used in an iron making process by organic carbon.

The present invention provides a method of operating of an iron making installation, the method comprising the steps of:

a. Drying waste material using a drying gas, the drying gas comprising an exhaust gas from a sinter plant,
b. Roasting the dried waste material using a roasting gas, so as to produce coal and a roasting exhaust gas.

The operating method may also comprise following characteristics, taken alone or in combination:

- the drying gas comprises at least 50% of an exhaust gas from a sinter plant,
- the method further includes a step of recycling at least a part of the roasting exhaust gas to the sinter plant,
- the drying gas has a temperature of at least 70° C.,
- the sinter plant exhaust gas has a temperature comprised between 100 and 150° C. when it is mixed with other components to form the drying gas,
- the roasting is performed at a temperature comprised between 200 and 320° C.,
- at least a part of the roasting exhaust gas is used as part of the drying gas,
- the roasting exhausts gas is used in the roasting step as part of the roasting gas,
- after the roasting step the coal is used as raw material into an iron making process,
- after the roasting step the coal is subjected to a milling step and milled coal is injected into a blast furnace through a tuyere,
- the milled coal has a particle size inferior to 10 μm,
- at least 4% in weight of solid material injected through the tuyere is milled coal,
- after the drying step, the dried material has moisture content inferior to 10%,
- the roasting exhausts gas is injected into an iron making process,
- the roasting exhausts gas is sent to a power plant,
- the waste material is an organic waste material,
- the organic waste material is waste wood.

The present invention also provides an installation comprising:

a. a dryer able to dry waste materials using a drying gas and comprising an injector to inject the drying gas into the dryer, b. a roaster able to roast the dried waste material at a temperature comprised between 200 and 320° C. using a roasting gas, so as to produce coal and a roasting exhaust gas, c. a sinter plant producing sintered material and sinter exhaust gas, d. a first collector to collect sinter exhaust gas, e. a connector defined to connect the first collector to the injector so as to inject a part of the sinter exhausts gas into the dryer.

The installation according to the invention may also comprise a belt dryer as the dryer.

The installation according to the invention may also comprise a pyrolysis reactor as the roaster.

BRIEF DESCRIPTION OF THE DRAWINGS

The invention will be better understood upon reading the description which follows, given with reference to the following appended figures.

DETAILED DESCRIPTION

Figure 1:
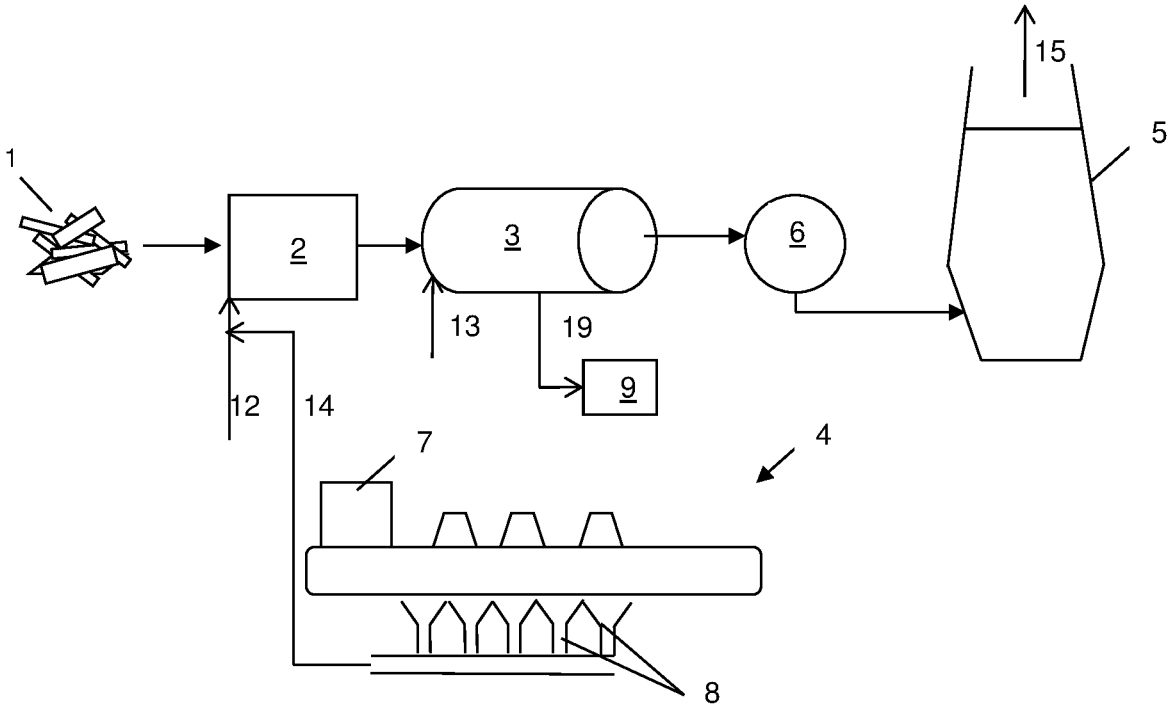
FIG. 1 illustrates an example of installation to implement a method according to a first embodiment the invention

The installation comprises a drying equipment 2, a roasting equipment 3, a sinter plant 4 and an iron making installation 5. In another embodiment the installation may further comprises a mill 6. In the following description the iron making installation 5 is a blast furnace 5 but it could also be a Direct Reduction furnace or any DRI installation.

Waste material 1 which can be for example chosen among waste trash, industrial waste or organic waste, is loaded into drying equipment 2. The waste material 1 is preferably organic waste, and more preferably wood waste, by example coming from dismantled buildings. The drying equipment is for example a belt dryer or a rotary kiln dryer.

During the drying step, a drying gas 12 is injected at an injector shown schematically as an arrow head inside the drying equipment 2 in order to bring the necessary heat to dry the waste material 1. The gas 12 has preferably a temperature of at least 70° C.

Once the drying step is over, preferably when the waste material has moisture content inferior to 10%, and most preferably inferior to 5%, the dried waste material is sent to roasting equipment 3. The roasting equipment 3 is preferably designed so as to avoid contact between roasting gas and dried material. It is, for example, a pyrolysis reactor or a rotary kiln.

During the roasting step, a roasting gas 13 is injected inside the roasting equipment 3 so as to heat the dried waste material. The heat can be brought directly by the roasting gas or through burners, fuel of which being the roasting gas 13. The roasting step is preferentially performed at a temperature comprised between 200° C. and 320° C. It produces a roasted waste material but generates also roasting exhaust gas 19. This roasting exhaust gas 19 contains volatile compounds such as Cl, $SO_x$ or $NO_x$ resulting from the roasting of the waste material. This roasting exhaust gas has to be treated in a specific treatment installation 9 to capture the volatile compounds and avoid releasing them into the atmosphere.

The roasted waste material, also called coal or biocoal is then injected into the blast furnace 5. It may so replace traditional coke or fossil coal as carbon source and consequently improve the overall carbon balance by avoiding use of fossil carbon.

Optionally the coal or biocoal is first sent to a mill 6 where it is milled to particles having a size inferior to 200 μm, and preferentially a size inferior to 150 μm. The fine coal or biocoal is then injected into the blast furnace through a tuyere (not represented) as a substitute to coal in the known method of Pulverized Coal Injection (PCI).

According to the invention the installation further comprises a sinter plant 4. In a sinter plant, iron ore fines are agglomerated with fluxes, such as limestone or olivine, and with solid fuel, such as coke breeze or anthracite, at high temperature, to create a product that can be used in a blast furnace 5. Basically, and as way of illustration, in a sinter plant, material is fed by hoppers in multi layers to a circular belt where it is ignited by an ignition hood 7. Air and fumes are sucked by wind boxes 8 from the bottom of the bed of material throughout the sintering machine to help the ignition process. Fire penetrates the material gradually along the belt, until it reaches the hearth layer. The fine particles are then melted together and agglomerated in a sinter cake once cooled. This sinter cake is then cracked and further cooled in a sinter cooler (not illustrated) before being loaded into the blast furnace 5. The sinter cooler also emits exhaust gas, mainly hot air.

The air and fumes sucked by the wind boxes 8 as well as hot air emitted by the sinter cooler are called sinter exhaust gas 14. According to the invention, this sinter exhaust gas 14 is sent to the drying equipment so as to be used as part of the drying gas 12. This drying gas 12 comprises at least 50% of sinter exhaust gas 14, and more preferably more than 80%. The drying gas 12 may additionally be composed of natural gas. The sinter exhaust gas 14 may be composed exclusively of the air and fumes sucked by the wind boxes 8, or exclusively of hot air emitted by the sinter cooler, or of both of them. Optionally, the sinter exhaust gas 14 is first subjected to a cleaning step before being mixed with other components to form the drying gas 12. This cleaning step maybe for example performed by a filter bag installation.

The sinter exhaust gas 14 has preferentially a temperature comprised between 100 and 150° C. when it is mixed with other components to form the drying gas 12. The drying gas 12 may be exclusively constituted of the sinter exhaust gas 14.

As the sinter exhaust gas 14 comes from the ignited material on the circular belt, it has a high calorific power and so when used as part or total of the drying gas 12 in the drying step it always bring enough heat to dry the waste material 1, whatever its characteristics, and notably its moisture content. There is no more need to use external energy sources.

Figure 2:
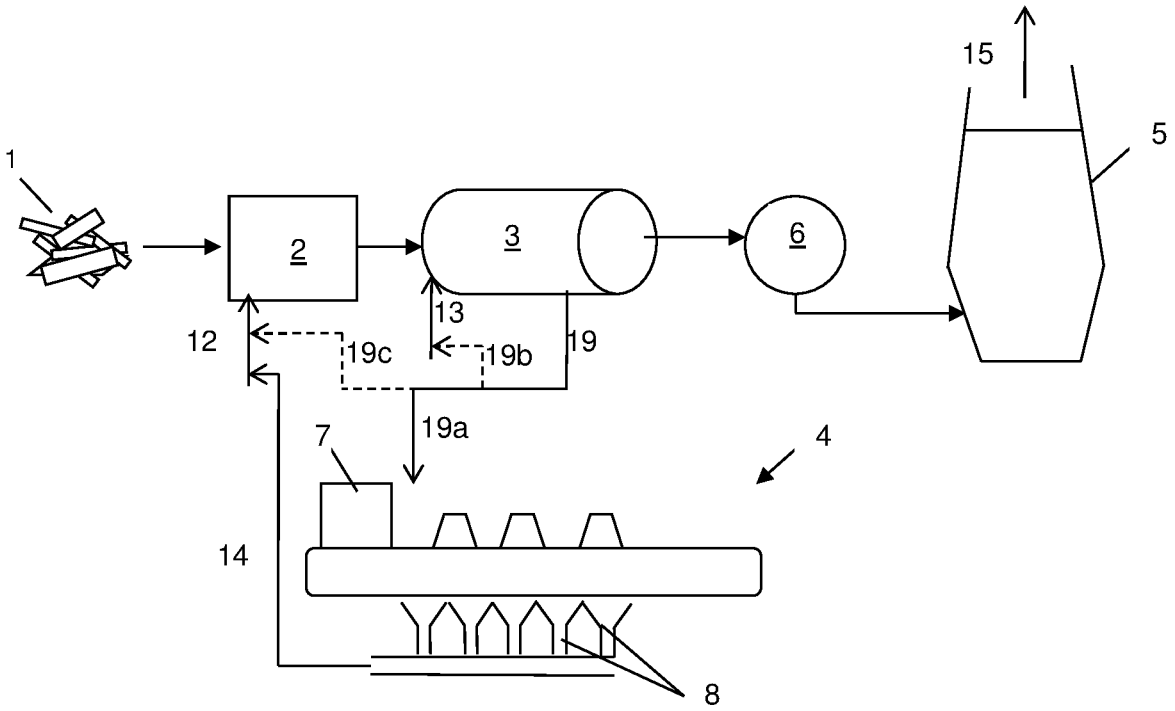
FIG. 2 illustrates an example of installation to implement a method according to another embodiment of the invention.

In a further embodiment, as illustrated in FIG. 2, the roasting exhaust gas 19*a* is not sent to a gas treatment installation 9 but is rather sent to the sinter plant 4 where it may replace a portion of the solid fuel which is mixed with the iron fines. This prevents the use of additional costly equipment and avoids the release of pollutants into the atmosphere.

In another embodiment, also illustrated on FIG. 2 in dotted lines, the roasting exhaust gas 19*b* is recycled into the roasting equipment 3, where it serves as part of the roasting gas 13 to heat the dried waste material. It can also be used as part 19*c* of the drying gas 12 for the drying step.

In another embodiment, the roasting exhaust gas may be used in stoves to heat air which is then blown into the blast furnace.

In another embodiment, the roasting exhaust gas may be sent to a power plant to produce electricity.

In further embodiment, the exhaust gas of the blast furnace, also called top gas or any steelmaking exhaust gas such as coke oven gas or converter gas maybe used as part of the drying or roasting gases.

All the embodiments of the invention thus described may be used in combination with one another.

What is claimed is:

1. A method of operating of an iron making installation, the method comprising the steps of:

drying waste material using a drying gas, the drying gas comprising an exhaust gas from a sinter plant, roasting the dried waste material using a roasting gas, so as to produce coal and a roasting exhaust gas, using the coal as a raw material in an iron making process, and recycling at least a part of the roasting exhaust gas to the sinter plant.

2. The operating method according to claim 1, wherein the drying gas comprises at least 50% of the exhaust gas from the sinter plant.

3. The operating method according to claim 1, wherein the drying gas has a temperature of at least 70° C.

4. The operating method according to claim 2 wherein the sinter plant exhaust gas is mixed with other components to form the drying gas, and has a temperature between 100 and 150° C. when mixed with the other components to form the drying gas.

5. The operating method according to claim 1, wherein the roasting is performed at a temperature between 200 and 320° C.

6. The operating method according to claim 1, wherein at least a part of the roasting exhaust gas is used as part of the drying gas.

7. The operating method according to claim 1, wherein the roasting exhaust gas is used in the roasting step as part of the roasting gas.

8. The operating method according to claim 1, wherein after the roasting step the coal is subjected to a milling step and milled coal is injected into a blast furnace through a tuyere.

9. The operating method according to claim 8, wherein the milled coal has a particle size inferior to 10 μm.

10. The operating method according to claim 8, wherein at least 4% in weight of solid material injected through the tuyere is milled coal.

11. The operating method according to claim 1, wherein, after the drying step, the dried material has moisture content inferior to 10%.

12. The operating method according to claim 1, wherein the roasting exhaust gas is injected into an iron making process.

13. The operating method according to claim 1, wherein the roasting exhaust gas is sent to a power plant.

14. The operating method according to claim 1, wherein the waste material is an organic waste material.

15. The operating method according to claim 5, wherein the organic waste material is waste wood.

16. An installation operating the method of claim 1 comprising: a dryer for drying the waste material using the drying gas injected by an injector into the dryer; a roaster for roasting the dried waste material using the roasting gas so as to produce the coal and the roasting exhaust gas; the sinter plant producing sintered material and sinter exhaust gas; a first collector to collect the sinter exhaust gas; a connector connecting the first collector to the injector so as to inject a part of the sinter exhaust gas into the dryer.

17. The installation according to claim 16, wherein the dryer is a belt dryer.

18. The installation according to claim 16, the roaster is a pyrolysis reactor.

19. A method of operating of an iron making installation, the method comprising the steps of: drying waste material using a drying gas, the drying gas comprising an exhaust gas from a sinter plant and the exhaust gas from the sinter plant comprises at least 50% of the exhaust gas, roasting the dried waste material using a roasting gas, so as to produce coal and a roasting exhaust gas, and using the coal as a raw material in an iron making process.

20. The operating method according to claim 19, wherein the drying gas has a temperature of at least 70° C.

21. The operating method according to claim 20, wherein the sinter plant exhaust gas is mixed with other components to form the drying gas, and has a temperature between 100 and 150° C. when mixed with the other components to form the drying gas.

22. The operating method according to claim 19, wherein the roasting is performed at a temperature between 200 and 320° C.

23. The operating method according to claim 19, wherein at least a part of the roasting exhaust gas is used as part of the drying gas.

24. The operating method according to claim 19, wherein the roasting exhaust gas is used in the roasting step as part of the roasting gas.

25. The operating method according to claim 24, wherein after the roasting step the coal is subjected to a milling step and milled coal is injected into a blast furnace through a tuyere.

26. The operating method according to claim 25, wherein the milled coal has a particle size inferior to 10 μm.

27. The operating method according to claim 25, wherein at least 4% in weight of solid material injected through the tuyere is milled coal.

28. The operating method according to claim 26, wherein, after the drying step, the dried material has moisture content inferior to 10%.

29. The operating method according to claim 26, wherein the roasting exhaust gas is injected into an iron making process.

30. The operating method according to claim 26, wherein the roasting exhaust gas is sent to a power plant.

31. The operating method according to claim 19, wherein the waste material is an organic waste material.

32. The operating method according to claim 21, wherein the organic waste material is waste wood.

* * * * *